United States Patent [19]

Chazé

[11] 4,036,479

[45] July 19, 1977

[54] CUPOLA FURNACE

[75] Inventor: Louis G. Chazé, Rennes, France

[73] Assignee: Centre Technique des Industries de la Fonderie, Paris, France

[21] Appl. No.: 685,699

[22] Filed: May 12, 1976

[30] Foreign Application Priority Data

May 20, 1975 France ..... 75.15668

[51] Int. Cl.[2] ..... C21B 7/14

[52] U.S. Cl. ..... 266/195; 266/166

[58] Field of Search ..... 75/13, 24, 30, 46; 266/195–197, 166, 236, 239, 227, 229–231

[56] References Cited

U.S. PATENT DOCUMENTS

| | | | |
|---|---|---|---|
| 691,474 | 1/1902 | Lincoln | 266/195 |
| 728,727 | 5/1903 | Von Kerpely | 266/195 |
| 1,231,349 | 6/1917 | Herreshoff | 75/24 |
| 1,357,781 | 11/1920 | Koppers | 266/195 |
| 3,589,699 | 6/1971 | Bogan | 266/236 |

*Primary Examiner*—Gerald A. Dost

*Attorney, Agent, or Firm*—Brooks, Haidt, Haffner & Delahunty

[57] ABSTRACT

An improved cupola furnace which comprises, in combination, on the one hand at least one tap hole for the pig iron opening into the crucible level with the hearth, a passage for evacuating the slag and air-blowing tuyeres, on the other hand, a storage tank closed by a cover and permanently communicating, near its bottom, via the tap hole, with the crucible, finally a removal siphon permanently communicating with the tank via an opening which opens near its bottom and with the outside via an overflow sill, at least one pneumatic device being connected to the upper part of the tank and enabling this latter to be selectively placed under two different pressures.

8 Claims, 20 Drawing Figures

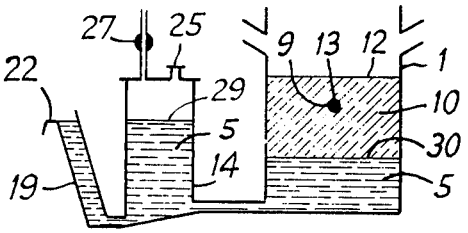
FIG. 8
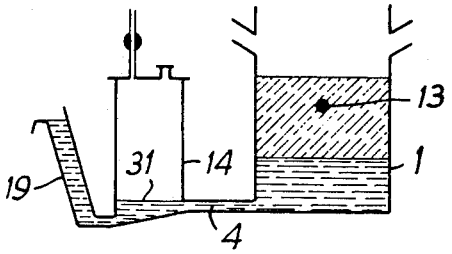
FIG. 9
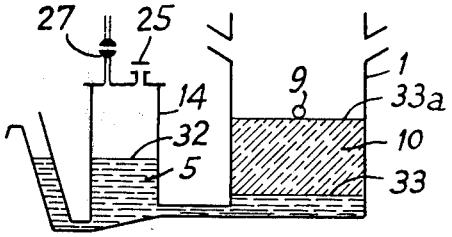
FIG. 10
FIG. 11
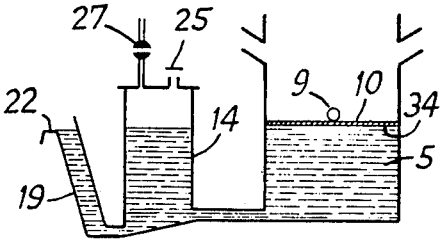
FIG. 12
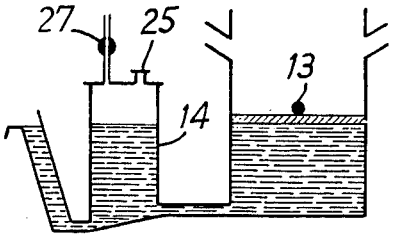
FIG. 13
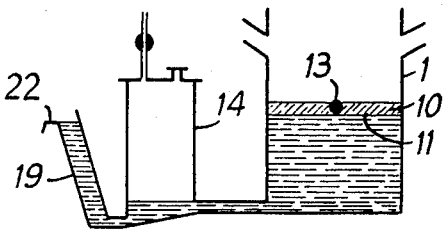

CUPOLA FURNACE

The present invention relates to an improved cupola furnace for controlling the tapping of the pig iron, without cutting off the blast and leaving the tap hole constantly open.

The discontinuous, as opposed to the continuous, removal of the pig iron by tapping, presents the following advantages:

the loss of temperature of the pig iron is limited to the minimum;

maximum recarburisation in the cupola furnace;

reduction of the heterogeneities of analysis, by maintaining a bath in the cupola furnace;

improvement in certain cases of the yield of the additions and the efficacy of the inoculation by carrying out the operation at higher temperature and reducing the waiting periods after treatment;

reduction in investments by avoiding the purchases of a mixing ladle;

limitation of the consumption of fuel for pre-heating and heating this mixing ladle.

However, the major drawback of the discontinuous removal resides in the tapping operation itself, as this is a delicate and even dangerous operation for the workman who is carrying it out, in view of the spatterings which are often produced.

Now, this operation may be repeated from 10 to 15 times per hour and sometimes even more.

The working conditions are, furthermore, arduous in view of the heat radiated by the metal.

If this operation is not performed well, the cupola furnace is liable to be unstopped inoportunely, this resulting in the following disadvantages: risks for the personnel in the vicinity, loss of metal, disturbed smelting, etc.

Obturations of the tap hole, called plugs, may also occur, at the beginning of smelting or particularly after stoppages. This frequently results in a deterioration of the tap hole which disturbs the smelting for the whole of its duration.

In any case, it is always difficult to ensure a correct stopping of the top hole when the level of metal in the cupola furnace is high (which is desirable for the homogenisation of the metal) and when the air pressure is high (which is more and more frequent in modern, high cupola furnaces); the tendency of the cupola men is then to maintain the level of pig iron in the cupola furnace low and to stop blasting too often, this also disturbing the smelting.

It should also be noted that the discontinuous casting distributes the metal at a low level and often requires that the whole of the installation be raised, this being expensive.

For all these reasons, it is more and more difficult to find and train personnel and numerous smelters are obliged to choose continuous tapping which has the advantage of eliminating the tapping and stopping operations, but which has the drawback of leading to a drop in temperature of the pig iron by 50° to 100° C, which drop is expensive and detrimental in a period when there is a shortage of energy.

It is therefore an object of the present invention to remedy the disadvantages of discontinuous removal of the pig iron, resulting from the positioning of a plug stopping the tap hole and from the tapping, while conserving the advantages of this mode of removal which it improves.

Furthermore, for the cupola furnaces with continuous tapping, when the flow of the metal has to be interrupted for a short duration of a few minutes to change ladles, for example, it is necessary to cut off the blast.

The present invention also has for its object to maintain the cupola furnace in operation without disturbing its functioning by stoppage of the blast, while preventing the pig iron produced from reaching the tapping spout.

To attain these aims, the cupola furnace comprises, in its side wall, in manner known per se, on the one hand at least one tap hole for the pig iron opening into the crucible level with the hearth, on the other hand a passage for evacuating the slag, and finally, air-blowing tuyeres connected to an air-chamber and extending into the upper part of the crucible.

In accordance with the invention, the cupola furnace applies a process known in another technical sector, whereby a permanent communication is established between, on the one hand, an enclosure producing the liquid metal and a storage enclosure, on the other hand, said latter and the outside by a siphon, the pressure in this storage enclosure being increased when the metal is to be evacuated. To this end, it comprises a storage tank which is in permanent communication, near its bottom, with said crucible via the or each tap hole and with the siphon via an opening whose upper edge is located below the level of the upper edge of the or each tap hole, the upper part of the tank, closed by a cover, being connected to at least one pneumatic device capable of placing this tank under a relatively low filling pressure or under a higher removal pressure, and the upper overflow sill of the siphon being located above the maximum level admissible of the pig iron in the crucible.

According to a preferred embodiment, the above-mentioned pneumatic device comprises two selectively closable openings, a first communicating with the atmosphere and the second being connected to a source of compressed gas at a pressure higher than atmospheric pressure; when the cupola-furnace is adapted to continuous tapping, the second opening may be connected to the air-chamber.

In addition, the tank may be equipped with a device for incorporating addition products in the bath.

Moreover, in the case of a cupola furnace with discontinuous removal, the tank and its equipment may cooperate with an automatic deslagging device which, in known manner, comprises a siphon communicating with the crucible via the above-mentioned passage for evacuating the slag, the lower edge of this passage being close to the hearth of the crucible while its upper edge is located below the maximum level admissible of the pig iron in this crucible which level determines that of the sill of said siphon above which the slag periodically flows.

The invention will be more readily understood on reading the following description with reference to the accompanying drawing, in which.

FIGS. 6, 6A, and 7, 7A are diagrams similar to the preceding ones, showing for a third embodiment of the process, the filling of the tank and the removal of the pig iron, respectively.

Figure 1:
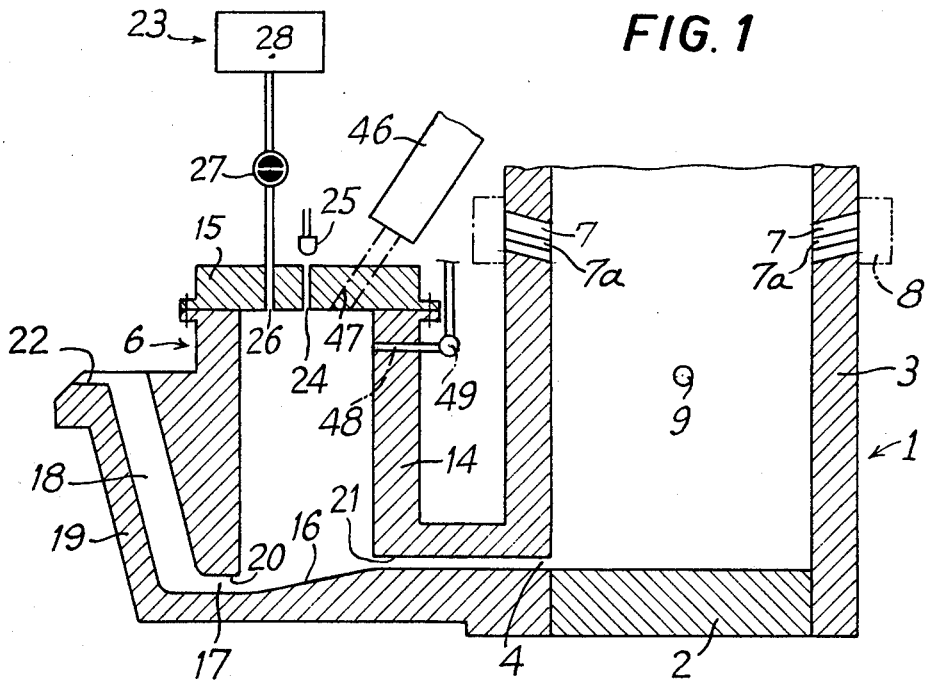
FIG. 1 is a schematic section showing part of an improved cupola furnace with discontinuous removal according to the invention.

FIGS. 8 to 13 are sequential diagrams, illustrating the different characteristic phases of the functioning of the improved cupola furnace of FIG. 1.

Figure 14:
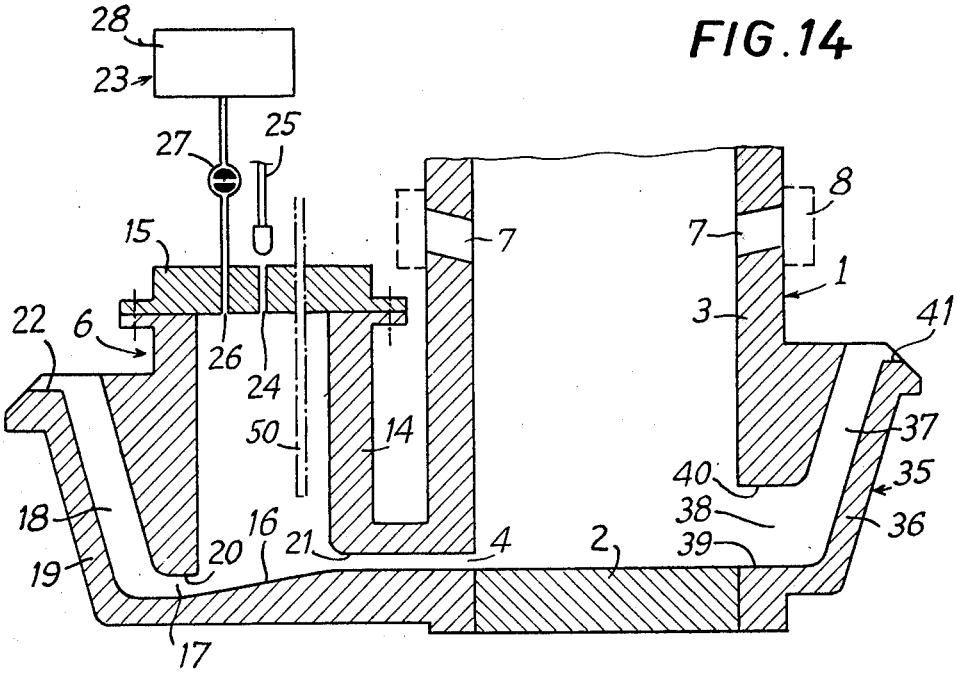

FIG. 14 is a section similar to the one of FIG. 1, showing for the same part of the cupola the improved device of the invention combined with an automatic deslagging device.

Figure 15:
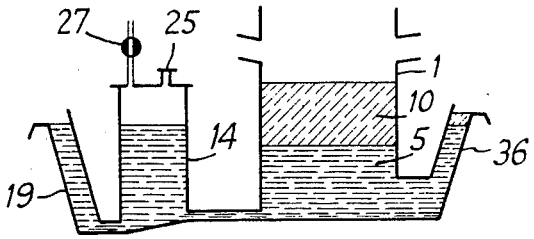
Figure 16:
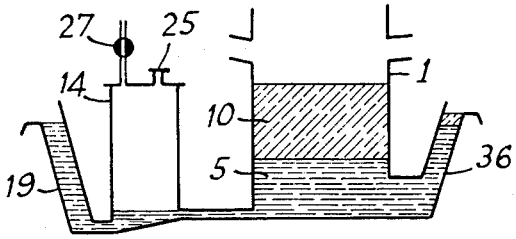
Figure 17:
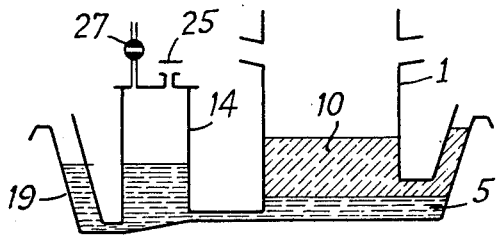

FIGS. 15 to 17 are sequential diagrams similar to the preceding ones, but concerning the improvements according to FIG. 14.

Figure 18:
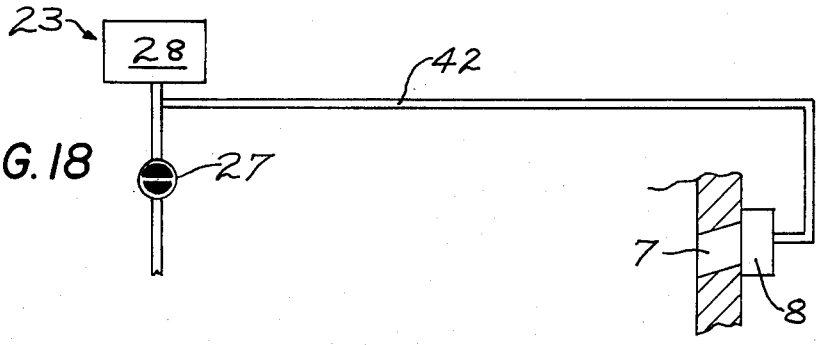

FIG. 18 is a fragmentary, schematic drawing illustrating a modification of the embodiment shown in FIG. 1.

Referring now the drawings, FIG. 1 shows a cupola furnace comprising, at its base, a crucible 1 constituted by a hearth 2 and a side wall 3 made of refractory material lining a metal jacket.

The wall 3 defines at least one tap hole 4 for the pig iron 5 opening, one the inside, level with the hearth 2 and, on the outside, into a transfer device 6.

The wall 3 also defines, in the upper part of this crucible, openings 7 distributed over the periphery and converging slightly downwardly. These openings are intended to receive air-blowing tuyeres 7*a* connected to an air chamber 8 surrounding the structure.

The wall 3 finally defines at least one passage 9 for evacuating the slag 10; the or each passage opens into the crucible above the minimum level 33 that may be reached by the pig iron (FIG. 10); however, they are located at a lower level with respect to the above-mentioned tuyeres and at the maximum level 12 of the slag (FIG. 8) which extends below these latter; furthermore, the or each passage 9 is obturated between two successive deslagging operations, but a plug 13 (FIGS. 8, 9, 12 and 13).

The transfer device 6, more particularly forming the subject matter of the present invention, comprises a strong tank 14 hermetically closed by a dismountable cover 15, the tank permanently communicates near its bottom 16, via the or each tap hole 4, with the crucible 1 and via an opening 17 with the internal upwardly directed plug 18 of at least one siphon 19.

In order to prevent the pressurised gas contained in the tank 14 from escaping, at the end of removal of metal via siphon 19, taking along with it slag or any other matter that may float on the metal 5 in the tank 14, the upper edge 20 of the opening 17 is located below the level of the upper edge 21 on the or each tap hole.

The upper sill 22 of the siphon 19 allowing the overflow of the pig iron contained in the tank 14 extends, at least, to the maximum admissible level 11 of the pig iron in the crucible 1.

The transfer device 6 also comprises a pneumatic device 23.

In the example shown in FIGS. 1 to 3, and 8 to 13, the pneumatic device 23 comprises:

a first opening 24 communicating directly with atmosphere, but stoppable by a plug 25, a second opening 26 connected, via a two-way valve 27, to a source 28 of compressed gas at a pressure higher than atmospheric pressure.

In this way, before the removal of the pig iron (FIG. 2), the stopper 25 is open and the valve 27 is closed, with the result the tank 14 is isolated from the source of compressed gas 28, but that the opening 24 puts this tank at atmospheric pressure. The pig iron 5 coming from the crucible 1 may therefore fill said tank up to the level of the sill 22 of the siphon 19, since the pressure acting on the pig iron in the crucible is at least equal to atmospheric pressure.

For the removal of the pig iron (FIG. 3), the stopper 25 is closed and the valve 27 connects tank 14 to the source of compressed gas 28, with the result that the pressure prevailing in said tank and acting on the pig iron 5 which is contained in this tank being driven back through the siphon 19 to the flow beyond the over-flow sill 22.

The installation functions in the manner set forth hereinafter with reference to FIGS. 8 to 13.

Immediately before the removal of metal which precedes deslagging, the passage 9 for evacuating the slag is closed by a plug 13, the stopper 25 is open and the valve 27 is closed with the result that the tank 14 is at atmospheric pressure. At the above-mentioned instant, the liquids balance as shown in FIG. 8: the slat 10 is at maximum quantity and its level reaches the upper limit 12; the pig iron 5 in the tank 14 and the siphon 19 has reached the upper level 29 and the overflow sill 22; the pig iron 5 in the crucible 1, by hydrostatic equilibrium and under the effect of the pressure of the blast, is at an intermediate level 30.

When the tapping is to begin (FIG. 8), the cupola man closes the stopper 25 and opens the valve 27. A pressure greater than atmospheric pressure is therefore established in the tank 14 and has for its effort to drive back the pig iron 5 contained therein to the outside, this pig iron then flowing above the overflow sill 22.

The tapping may be interrupted at any moment by closing the valve 27 and by opening the stopper 25. In any case, it stops when the level 31 of the pig iron in the tank 14 (FIG. 9) reaches the top of the tap hole 4 since, at this instant, the compressed gas may penetrate into the cupola furnace; at this moment, the pig iron now flows through the siphon 19 to the outside, only at it is produced in the cupola furnace.

It is important to note that, with a suitable layout of the or each conduit 4, the slag which would possibly be contained in the tank 14 or any other body floating on the metal, of dimensions smaller than the hole 4 if it is a solid, would be taken along by the compressed gas towards the cupola.

As soon as the removal of pig iron is terminated, the cupola man closes the valve 27 and opens the stopper 25 (FIG. 10). A new hydrostatic equilibrium is established in view of the fact that the tank 14 is brought to atmospheric pressure. The pig iron 5 rises in the tank and its siphon up to the level 32 and falls in the crucible 1 down to level 33.

The layer of slag 10 follows and its level 33*a* may reach that of the passage 9 for evacuating the slag. The cupola man then pierces the plug 13 to clear this passage.

The production of pig iron and slag continues (FIG. 11); the level of the pig iron rises both in tank 14 and siphon 19, and in crucible 1; the pig iron pushes back the slag which flow through passage 9.

When the pig iron is flush with the overflow sill 22 (FIG. 11), its level 34 in the crucible is very close to the maximum 11 and the thickness of the layer of slag 10 corresponds to the minimum value which has been set on choosing the height of the deslagging passage 9.

From this instant, the passage 9 is closed by a plug 13 (FIG. 12) and the cupola man opens the valve 27 at the same time as he closes stopper 25. A pressure greater than atmospheric pressure is established in the tank 14.

This results in the pig iron which is contained in the tank 14 flowing (FIG. 13) through the siphon 19 above the overflow sill 22 in the same manner as described previously with reference to FIG. 9. The only difference resides in the fact that the level 11 of the pig iron in the crucible is maximum and that the thickness of the layer of slag 10 is reduced to the predetermined minimum.

From that instant, there is a fresh filling of the tank 14, followed by a new removal of the pig iron, as indicated hereinbefore.

The transfer device 6 which has already been described with reference to FIGS. 1 to 3 and 8 to 13, concerning a cupola furnace with intermittent deslagging by manual tapping is also applicable to a cupola furnace with discontinuous removal of metal and with automatic deslagging.

In fact, as shown in FIG. 14, all the elements constituting the transfer device 6 are found on the cupola furnace which has been shown, which is equipped with an automatic deslagging device 35, these elements being designated by the same reference numerals.

The automatic deslagging device 35 comprises, as is well known from U.S. Pat. application No. 584,387 of June 6, 1975, a siphon 36 whose internal upwardly directed pipe 37 communicates at its base with the crucible 1 via a passage 38; the lower edge 39 of this passage is close to the hearth 2, while its upper edge 40 is located below the maximum level admissible of the pig iron 5 in the crucible. The pipe 37 opens to the outside by a sill 41 enabling the periodic overflow of the slag and extending to a level determined by the maximum level, mentioned above, of the pig iron.

The functioning of the transfer device 6 is strictly the same when the cupola furnace is equipped with the automatic deslagging device 35; this is clearly seen in FIGS. 15 to 17 and the only difference shown by these Figures resides in the levels of the pig iron 5 and the slag 10 in the cupola, by reason of the deslagging which takes place automatically between two successive removals of pig iron. (compare FIG. 15 with FIGS. 8 and 11, FIG. 16 with FIGS. 9 and 13, FIG. 17 with FIG. 10).

It should simply be noted that, after a removal of pig iron (FIG. 16) and when the levels balance by connecting the tank 14 to the open air (FIG. 17) the level of the pig iron in this crucible extends beneath the upper edge 40 of the passage 38; in this way, the slag penetrates into the internal pipe 37 of the siphon 35, as the production of pig iron continues, said pig iron pushes and traps part of the slag in this pipe 37; on rising, the pig iron therefore evacuates the trapped slag, above the sill 41.

The transfer device 6, whether it be applied to a cupola furnace with deslagging by tapping (FIG. 1) or to a cupola furnace with automatic deslagging, (FIG. 14), enables the following to be obtained:

a considerable simplification of operation of the cupola furnace as well as increased safety, associated with the elimination of the tapping and stopping; this operation may be rendered automatic in the case of automatic deslagging;

a reduction in personnel in a post where recruitment is difficult;

high flexibility of removal of the metal, the importance of the tappings being variable over a large range and their duration being adjusted as desired;

a substantial gain in temperature of the metal that may be translated by a saving of fuel of the order of 1 to 2% of coke;

an improvement in the quality of analysis of the liquid metal further to a better homogenisation in the cupola furnace and the tank and by a regularisation of the operation;

a financial sacing in all cases where the purchase of a mixing ladle is avoided.

The transfer device 6 may also be adapted to a continuous tapping spout in order to give the possibility of interrupting the tapping of the pig iron for a fairly short period of time (e.g., a few minutes) witout cutting off the blast.

In this case, the tank 14, during the normal phase of flow of the liquid pig iron, is isolated from the atmosphere by closure of the stopper 25 and placed under slight gaseous pressure, e.g., in air pressure equilibrium with the air chamber 8 of the cupola furnace by opening the valve 27 which is then connected to this air chamber by a pipe 42 shown in broken lines in FIG. 1. To interrupt the tapping, it is sufficient to close the valve 27 and open the stopper 25; in fact, the pig iron as it is produced in the cupola accumulates in the tank 14 since the pressure therein has been reduced to atmospheric pressure and can no longer drive said pig iron back through the siphon 19.

Figure 2:
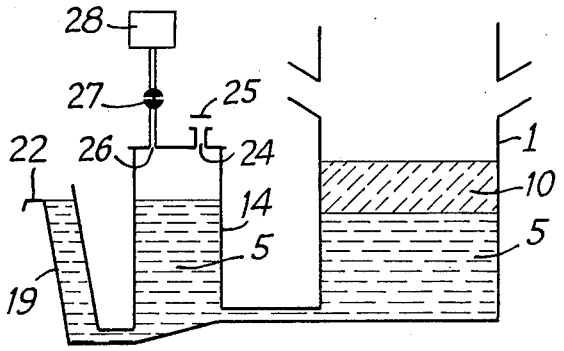
FIGS. 2 and 3 are diagrams illustrating a first embodiment of the process applied to the cupola furnace of FIG. 1 and showing the levels of the pig iron and the slag, before and after removal respectively.
Figure 3:
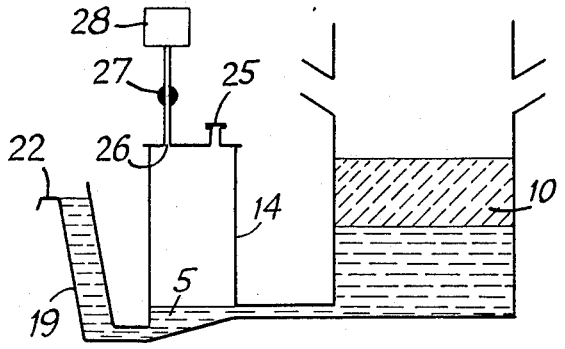

The various applications of the transfer device 6 set forth hereinbefore (FIGS. 1 and 14) have been described in the particular case where the tank 14 is filled at atmospheric pressure (FIG. 2) and the removal of the pig iron is produced by placing said tank at a higher pressure (FIG. 3).

Figure 4:
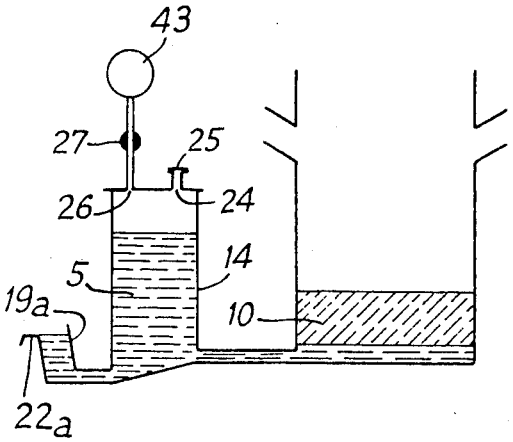
FIGS. 4 and 5 are views similar to FIGS. 2 and 3, referring to a second embodiment of the process.
Figure 5:
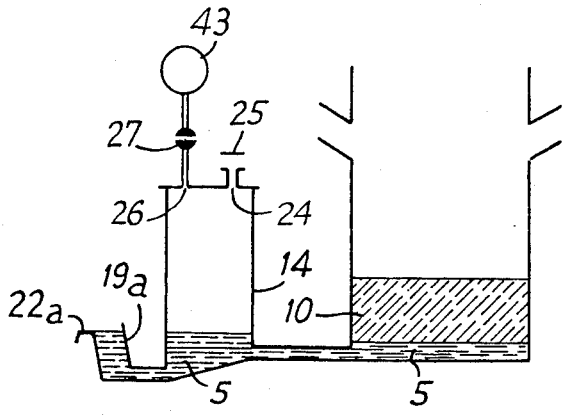

However, a second embodiment illustrated in FIGS. 4 and 5 may be carried out concerning the cupola furnace with discontinuous removal of the metal for the embodiments defined with reference to FIGS. 1 and 14. The valve 27 is here no longer connected to a source of compressed gas 28, but to a source of rarefied air 43, also called source of vacuum. Consequently, the tank 14 is filled (FIG. 4) when the stopper 25 is closed and the valve 27 is open, in other words, when said tank is placed under reduced pressure; the removal of the pig iron is produced (FIG. 5) by returning the tank to atmospheric pressure by closing the valve 27 and opening the stopper 25. It is ascertained that the level of the sill **22*a* of the siphon 19*a* is, in this case (FIGS. 4 and 5), lower than in the preceding case (FIGS. 2 and 3**).

It is no longer possible, in this case, to drive back slag or matter floating on the metal 5 of the tank 14, towards the cupola furnace at the end of removal.

In the case of continuous tapping, adapted to this embodiment, the normal conditions of functioning are those of FIG. 5, i.e., valve 27 closed, opening 24 open. In order momentarily to stop the flow of the metal, without cutting off the blast, the cupola man places the tank 14 under reduced pressure by closing the opening 24, with the aid of the stopper 25, and by opening the valve 27.

Figure 6:
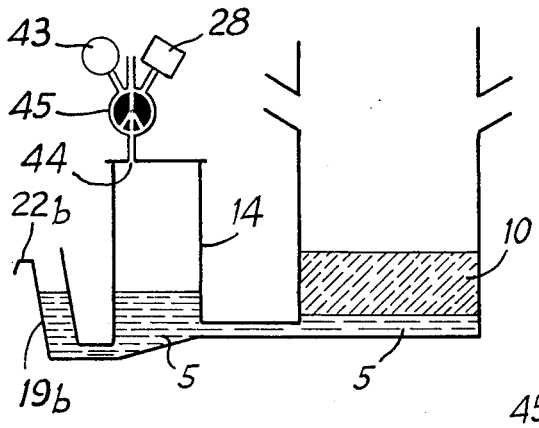
Figure 6A:
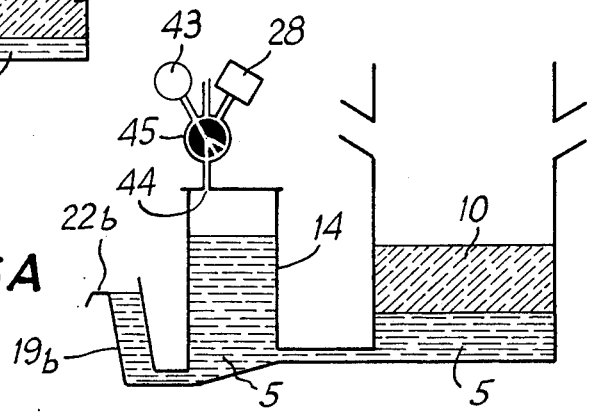
Figure 7:
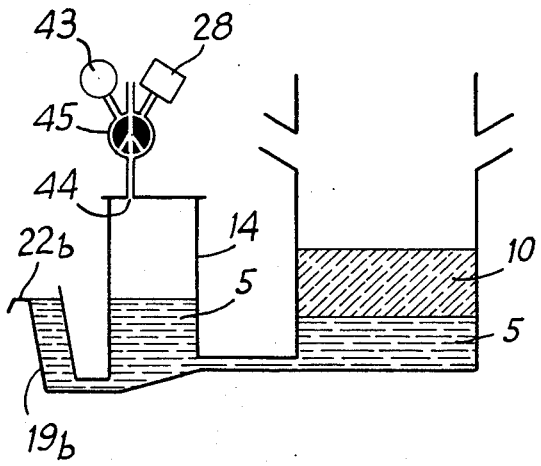
Figure 7A:
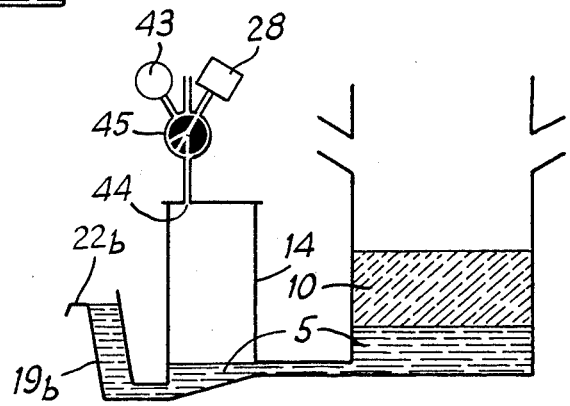

A third embodiment shown in FIGS. 6, 6A, 7, and 7A may be carried out concerning the cupola furnaces with discontinuous removal of the metal, for the embodiments described with reference to FIGS. 1 and 14. The two openings 24 and 26 of the tank 14 are to be replaced by a single opening 44 and this latter selectively connected, via a four-way valve 45, to the outside at atmospheric pressure (FIGS. 6 and 7) or to a source of compressed gas 28 (FIG. 7A) or to a source of vacuum 43 (FIG. 6A).

Under these conditions, the tank 14 is filled in two stages by means of the valve 45, by firstly connecting the opening 44 to atmosphere (FIG. 6), then, when the level of metal in the siphon **19*b* reaches the sill 22*b*, by connecting the opening 44 to the source of vacuum 43 (FIG. 6A**), in other words, by placing said tank under reduced pressure.

The pig iron is also removed in two stages, by manoeuvring the valve 45 in order firstly to place the opening 44 in relation with the atmosphere (FIG. 7) then, with the source of compressed gas 28 (FIG. 7A), in other words, by establishing in said tank a pressure greater than atmospheric pressure. This third embodiment (FIGS. 6, 6A, 7 and 7A) is particularly advantageous when the storage capacity of the liquid pig iron in the tank 14 is to be increased.

Furthermore, whatever the type of pneumatic device employed on the tank 14 and whatever the type of cupola furnace to which said tank is applied (discontinuous or continuous tapping of the pig iron, deslagging by tappings or automatically), this tank 14 may be equipped with a device for incorporating addition products in the bath, capable, in addition of cooperating with a device for blowing in an inert gas.

The treatment jar is constituted, according to the present invention, by the tank 14. In this case, it is a continuous tapping device.

For example, and as may be seen in FIG. 1, the device for incorporating addition products may be constituted by an injector 46 mounted on the cover 15 and connected to an opening 47 in this latter opening into the tank. The blow-in device may be a tuyere 48 connected to the upper part of said tank 14 above the maximum level of the pig iron in this latter and connected to a source of gas, preferably inert gas, by means of a connecting member 49 enabling the flow and pressure of this bubbling gas in the tank to be regulated, when said connecting member is open.

According to another example shown in FIG. 14, the addition products are distributed through at least one pipe 50 made of refractory material mounted on the cover 15 and immersed in the bath of the tank. Of course, a bubbling gas may be blown in through the pipe.

According to a technique known by U.S. Pat. No. 2,853,376 of Mar. 6, 1956, each pipe is made of graphite and yields carbon to the pig iron, the gas escaping through the pipe promoting recarburisation.

The process and the device forming the subject matter of the present invention, are applicable to the cupola furnaces for the production of pig iron at high temperature and possibly treated with addition products.

What is claimed is:

1. An improved cupola furnace system for controlling the tapping of pig iron without cutting off the blast and leaving the furnace tap hole constantly open, said cupola furnace comprising a hearth and a sidewall extending upwardly from the hearth for containing molten pig iron and slag up to a predetermined level, said sidewall having at least one tap hole at the level of said hearth and extending from adjacent said hearth to the exterior of said sidewall for removing molten pig iron from said furnace, said furnace also having a passageway extending from the interior of said sidewall to a point exteriorly thereof which is spaced upwardly from said hearth for removing slag from said furnace and having an air chamber and air-blowing tuyeres extending from said chamber to the interior of said sidewall at points above said predetermined level and said system further comprising:

a storage tank adjacent said furnace and having an upper end and a lower end and a first opening at said lower end, means connecting said tap hole with said opening in said lower end of said tank for the flow of molten pig iron from said furnace to said tank, said tank also having a second opening spaced from said first opening, the upper edge of said second opening being below the upper edge of said first opening, and having a siphon tube extending upwardly from said second opening for the flow of molten pig iron from said tank outwardly of said tube, said tube having a sill at the upper end thereof over which said molten pig iron flows when removed from said tank and said sill being located above said predetermined level;

means for sealing said upper end of said tank and thereby preventing the outflow of gas from said upper end thereof when said tank contains molten pig iron; and gas means connected to said upper end of said tank for changing the gas pressure in said upper end of said tank.

2. A cupola furnace system as set forth in claim 1, wherein said gas means comprises means for selectively opening said upper end of said tank to the atmosphere and means for supplying gas under a pressure above atmospheric pressure to said upper end of said tank.

3. A cupola furnace system as set forth in claim 2, further comprising means connecting said means for supplying gas to said furnace for applying gas pressure to the upper face of the molten pig iron in said furnace.

4. A cupola furnace system as set forth in claim 1, wherein said gas means comprises means for selectively opening said upper end of said tank to the atmosphere and means for reducing the pressure of the gas in said upper end of said tank to less than atmospheric pressure.

5. A cupola furnace system as set forth in claim 1, wherein said gas means comprises means for supplying gas under a pressure above atmospheric pressure, vacuum producing means and means for selectively connecting said upper end of said tank to said gas supplying means, to said vacuum producing means and to the atmosphere.

6. A cupola furnace system as set forth in claim 1, further comprising means connected to said tank for supplying addition products to molten pig iron in said tank.

7. A cupola furnace system as set forth in claim 6, wherein said means for supplying addition products comprises means connected to said upper end of said tank for supplying an inert gas to the interior of said tank and into the molten pig iron in said tank.

8. A cupola furnace system as set forth in claim 1, wherein said passageway for removing slag from said furnace is defined by a further siphon tube having a first opening communicating with the interior of said furnace adjacent said hearth and having a second opening above said last-mentioned first opening, said last-mentioned first opening having its upper edge below said predetermined level and said last-mentioned second opening having its lower edge above said last-mentioned upper edge and below said predetermined level, said lower edge of said last-mentioned second opening acting as a sill over which slag from said furnace may flow.

* * * * *

UNITED STATES PATENT AND TRADEMARK OFFICE

CERTIFICATE OF CORRECTION

PATENT NO. : 4,036,479

DATED : July 19, 1977

INVENTOR(S) : Louis G. Chaze

It is certified that error appears in the above-identified patent and that said Letters Patent are hereby corrected as shown below:

| | |
|---|---|
| Col. 1, line 21 | "purchases" should read --purchase-- |
| Col. 1, line 35 | "inoportunely" should read --inopportunely" |
| Col. 2, line 61 | "drawing" should read --drawings-- |
| Col. 3, line 24 | "one the inside" should read --on the inside-- |
| Col. 3, line 43 | "strong" should read --storage-- |
| Col. 3, line 47 | "plug" should read --pipe-- |
| Col. 4, line 32 | "effort" should read --effect-- |
| Col. 4, line 66 | "maximum 11" should read --maximum level 11-- |
| Col. 6, line 16 | "witout" should read --without-- |
| Col. 6, line 39 | "furnace" should read --furnaces-- |

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*